US008899447B2

(12) United States Patent
Chassaing

(10) Patent No.: US 8,899,447 B2
(45) Date of Patent: Dec. 2, 2014

(54) DEVICE FOR STORING, SELECTING, AND METERING BASE COLORS FOR PAINTING, PARTICULARLY AUTOMOBILE PAINTING

(71) Applicant: Fillon Technologies, Faverolles (FR)

(72) Inventor: Antoine Chassaing, Clevilliers (FR)

(73) Assignee: Fillon Technologies, Faverolles (FR)

( * ) Notice: Subject to any disclaimer, the term of this patent is extended or adjusted under 35 U.S.C. 154(b) by 0 days.

(21) Appl. No.: 13/845,408

(22) Filed: Mar. 18, 2013

(65) Prior Publication Data

US 2013/0233881 A1 Sep. 12, 2013

Related U.S. Application Data

(63) Continuation of application No. 12/737,178, filed as application No. PCT/FR2009/051102 on Jun. 11, 2009, now abandoned.

(30) Foreign Application Priority Data

Jun. 20, 2008 (EP) ..... 08290588

(51) Int. Cl.

| | |
|---|---|
| ***B67D 7/78*** | (2010.01) |
| ***B44D 3/08*** | (2006.01) |
| ***B67D 7/00*** | (2010.01) |
| ***B01F 13/10*** | (2006.01) |

(52) U.S. Cl.

CPC .. *B67D 7/00* (2013.01); *B44D 3/08* (2013.01); *B01F 13/1055* (2013.01)

USPC ..... 222/144; 222/1; 222/105; 222/386.5; 222/389; 222/95

(58) Field of Classification Search

USPC ..... 222/141, 144, 144.5, 94, 95, 105, 222/386.5, 389

See application file for complete search history.

(56) References Cited

U.S. PATENT DOCUMENTS

| | | | | |
|---|---|---|---|---|
| 2,094,702 | A * | 10/1937 | Hexter | 222/144 |
| 2,158,795 | A * | 5/1939 | Grubelic | 177/76 |
| 2,731,297 | A * | 1/1956 | Meyer | 141/27 |
| 3,042,259 | A * | 7/1962 | Eugel | 222/33 |

(Continued)

FOREIGN PATENT DOCUMENTS

| | | | | |
|---|---|---|---|---|
| DE | 4110299 C1 | * | 2/1993 | A45D 34/00 |
| EP | 0 813 901 | | 12/1997 | |

(Continued)

*Primary Examiner* — Kevin P Shaver

*Assistant Examiner* — Michael J Melaragno

(74) *Attorney, Agent, or Firm* — Jacobson Holman Hershkovitz PLLC

(57) ABSTRACT

A device (10) includes multiple containers storing different respective tints, a horizontal axis carousel carrying the containers disposed in a circumferential configuration, a support (18) for a collector receptacle (16), the carousel indexed to a delivery position where the expulsion orifice of a selected container is placed in register with the collector receptacle, with metering means controlling the expulsion of a predetermined quantity of tint into the collector receptacle, the carousel driven in permanent rotation to produce a gravity field that turns relative to the contents of the containers and that is suitable for preventing particles present in suspension in the tints from settling, the carousel has multiple cells (14) each defining a closed inside volume suitable for housing in airtight manner a flexible deformable pouch (22) containing one of the base tints, with means for pressurizing the inside volume of the cell prior to expelling the base tint.

9 Claims, 2 Drawing Sheets

(56) References Cited

U.S. PATENT DOCUMENTS

| | | | | | |
|---|---|---|---|---|---|
| 3,074,597 | A * | 1/1963 | Felts | 222/43 |
| 3,223,289 | A * | 12/1965 | Bouet | 222/209 |
| 3,270,920 | A * | 9/1966 | Nessler | 222/95 |
| 3,433,391 | A * | 3/1969 | Fox et al. | 222/95 |
| 3,578,217 | A * | 5/1971 | Miller | 222/218 |
| 4,147,278 | A * | 4/1979 | Uhlig | 222/94 |
| 4,280,637 | A * | 7/1981 | Runciman | 222/39 |
| 4,967,938 | A * | 11/1990 | Hellenberg | 222/144 |
| 5,060,826 | A * | 10/1991 | Coleman | 222/95 |
| 5,190,184 | A * | 3/1993 | Lechner | 220/581 |
| 5,535,951 | A * | 7/1996 | Utter | 239/322 |
| 5,938,080 | A * | 8/1999 | Haaser et al. | 222/144 |
| 6,067,906 | A * | 5/2000 | Ryan et al. | 101/335 |
| 6,096,007 | A * | 8/2000 | Haan et al. | 604/147 |
| 6,202,895 | B1 * | 3/2001 | Fox | 222/144 |
| 6,615,881 | B2 * | 9/2003 | Bartholomew et al. | 141/18 |
| 6,672,341 | B2 * | 1/2004 | Bartholomew et al. | 141/18 |
| 6,883,561 | B2 * | 4/2005 | Bartholomew et al. | 141/18 |
| 7,082,970 | B2 * | 8/2006 | Bartholomew et al. | 141/104 |
| 7,121,430 | B2 * | 10/2006 | Mink et al. | 222/135 |
| 7,347,344 | B2 * | 3/2008 | Engels et al. | 222/144 |
| 7,360,564 | B2 * | 4/2008 | Engels et al. | 141/83 |
| 7,475,710 | B2 * | 1/2009 | Bartholomew et al. | 141/104 |
| 7,527,078 | B2 * | 5/2009 | Driessen et al. | 141/9 |
| 7,963,955 | B2 * | 6/2011 | Freund et al. | 604/408 |
| 8,141,596 | B2 * | 3/2012 | Bartholomew et al. | 141/18 |
| 8,573,263 | B2 * | 11/2013 | Bartholomew et al. | 141/18 |
| 8,608,371 | B2 * | 12/2013 | Bartholomew et al. | 366/273 |
| 2004/0159676 | A1 * | 8/2004 | Adema | 222/144 |
| 2010/0108723 | A1 * | 5/2010 | Chassaing | 222/504 |
| 2012/0175383 | A1 * | 7/2012 | Engels et al. | 222/135 |
| 2012/0175385 | A1 * | 7/2012 | Voskuil | 222/144 |

FOREIGN PATENT DOCUMENTS

| | | |
|---|---|---|
| WO | WO 03/026457 | 4/2003 |
| WO | WO 2006/027450 | 3/2006 |
| WO | WO 2006/052863 | 5/2006 |

* cited by examiner

DEVICE FOR STORING, SELECTING, AND METERING BASE COLORS FOR PAINTING, PARTICULARLY AUTOMOBILE PAINTING

This is a continuation of Ser. No. 12/737,178, filed Dec. 15, 2010, which is a 371 of PCT/FR09/051102, filed Jun. 11,2009.

The invention relates to a device for storing, selecting, and metering base tints for paint, in particular (but in non-limiting manner) for paints that are prepared on demand by automobile repair professionals.

In this field, body repairers prepare the quantities of paint needed for repairing bodywork by mixing together a certain number of base tints. Each mixture is determined from a formula defined by the paint manufacturer, the formula giving the weight of each base tint to be incorporated for a given quantity of mixture that is to be obtained. Such preparation commonly involves mixing together five to ten base tints in order to obtain the particular shade specified by the paint manufacturer.

Most of the technical metering solutions that have been used in the past by body repairers are based on the principle of a metering lid that is fitted on a container in the form of a rigid tin, as described for example in WO 2006/027450 A2 (Fillon Investissement).

Other systems make use of base tints packaged in receptacles in the form of flexible pouches for single use. Such a pouch is fitted with a base enabling it to be connected to a metering valve or tube by means of a quick coupling type connector.

Outside the field of automobile repair, devices are also known for selecting and mixing base tints, e.g. a device of the kind described in U.S. Pat. No. 3,074,597 B1 (Felts) for preparing paints suitable for use in building, where the pigments are added to a white paint in order to obtain a particular color on demand. The device described in that document comprises a horizontal-axis rotary element having mounted thereon in a radial configuration a plurality of tanks storing the base tints. The rotary element is actuated so as to bring such-and-such a tank into a delivery position from which the desired quantity of pigment is ejected into a collector receptacle under the action of a piston incorporated in the tank.

In the field of cosmetics, WO 03/026458 A2 (IMX Labs, Inc.) describes a device presenting the same general configuration as described above, for preparing cosmetics such as nail varnishes on demand at points of sale close to consumers.

In the automobile repair field, the paints that are used, particularly paints of the latest generation, nevertheless give rise to a certain number of additional precautions and constraints, given their particular nature.

Firstly, for a professional who is repairing a portion only of the bodywork, it is necessary to obtain almost perfect color identity between the repaired portion and the remainder of the bodywork, which implies extremely accurate relative metering of the various base tints in the mixture.

Furthermore, present paints are more and more concentrated with ever-increasing covering power, whereas the areas that need repairing are becoming smaller and smaller. As a result, the quantities of mixture that need to be prepared are becoming very small, of the order of 30 grams (g) to 50 g, and in order to obtain the required color accuracy with such very small quantities of mixture, the accuracy with which each base tint needs to be metered is of the order of the weight of a single drop, i.e. about 0.03 g to 0.1 g.

Concerning their composition, the base tints used for automobile repair are constituted by a liquid matrix having solid particles incorporated therein. The liquid matrix contains binders, solvents, soluble organic inks, and various additives, so as to produce a liquid with specific gravity generally lying in the range 0.8 to 1. However the solid particles are mainly constituted by pigments, fillers, and metal particles, and they generally present specific gravity lying in the range 2 to 4.

Unless special precautions are taken, the difference in density between the solid particles and the liquid matrix would lead, under the effect of gravity, to the solid particles becoming deposited on the bottom of the paint container.

To mitigate that risk, in systems of the kind described in above-mentioned WO 2006/027450 A2 in which the base tints are stored in rigid tins, regular stirring is provided so as to maintain good homogeneity of the base tint. Each tin is fitted for this purpose with a special lid provided with a helix that is driven in rotation.

That enables the solid particles to be maintained in suspension in the matrix but presents two drawbacks:

- since the helix is driven in rotation by a shaft passing through the lid of the tin, it is necessary to provide dynamic sealing about that shaft. Unfortunately, tints are often corrosive and abrasive, so it is difficult to provide such sealing, and air manages to penetrate into the tin, or conversely tint manages to leak out from the tin; and
- above all, that system requires air to be introduced into the inside of the tins progressively as they are emptied in order to compensate for the volumes of tint that have been taken. The air tends to oxidize certain ingredients of the tint, to evaporate a fraction of the solvents, and to dry the surface of the tint. Furthermore, during stages of stirring while the helix is being driven, the phenomenon is made worse, since the tint is splashed onto the walls of the lid where it dries particularly quickly, since it presents a thickness that is small.

In the other technique that consists in storing the various base tints in flexible pouches, the tints are always protected from air, but the lack of mechanical stirring means that a solution needs to be found to keep the soluble particles in suspension.

The known solution to that problem consists in incorporating certain additives in the liquid matrix such as dispersants (which are particularly effective with small particles) and gelling agents (which are also effective with large particles).

Such additives nevertheless present drawbacks, insofar as they increase the viscosity of the base tints and thus make it more difficult to meter them out accurately. Furthermore, the physico-chemical characteristics of the base tint may turn out to be difficult to maintain over time since certain additives, in particular gelling agents, are sensitive to certain parameters such as temperature and aging.

The object of the invention is to propose a novel device for storing, selecting, and metering base tints that makes it possible to combine:

- the advantages of tints conserved in deformable containers or pouches that isolate the paint completely from air; and
- the advantages of tints that do not have additives such as dispersants and gelling agents.

In other words, the object of the invention is to propose such a device that makes it possible:

- to use base tints that are free of additives such as dispersants or gelling agents, and thus are not subjected to the problems associated with increased viscosity of the base tint or of viscosity that depends on external parameters such as temperature or aging;
- while conserving excellent homogeneity for the base tint; and protecting said base tint from any contact with air, so as to avoid the phenomena of loss of solvent and of spoiling various ingredients.

To this end, the invention proposes a device of the general type disclosed in above-mentioned U.S. Pat. No. 3,074,597 B1, i.e. a device that comprises in known manner:

- a plurality of containers storing different respective tints, each container having a tint expulsion orifice;
- a horizontal-axis carousel carrying said containers disposed in a circumferential configuration;
- a support for a collector receptacle;
- indexing means for causing the carousel to turn to a delivery position in which the expulsion orifice of a selected container is placed in register with the collector receptacle;
- metering means suitable for acting in the delivery position to control opening of the expulsion orifice to expel a predetermined quantity of tint into the collector receptacle; and
- drive means for driving the carousel in permanent rotation, continuously or at intervals, to produce a gravity field that turns relative to the contents of the containers so as to avoid particles present in suspension in the tints from settling.

In a manner characteristic of the invention, in order to achieve the above-mentioned objects:

- the carousel has a plurality of cells, each defining a closed inside volume suitable for housing in airtight manner a flexible deformable pouch containing a base tint, the cell and the associated pouch forming said container; and
- the device further includes a pressure source and means for establishing communication, at least for the selected container in the delivery position, between said pressure source and the closed inside volume of the cell prior to expelling said predetermined quantity of tint.

The cells may in particular be radial cells with the expulsion orifice of each container directed radially relative to the axis of the carousel.

Such a device lends itself to being loaded in various ways:

- by removable flexible pouches containing the base tints: the cells are then mounted in permanent manner on the carousel and the flexible pouches are introduced into respective cells of the device;
- by rigid or semi-rigid cartridges containing the flexible pouches that contain the base tints: the cells are then mounted in permanent manner on the carousel and the cartridges are introduced into the respective cells of the device;
- by cells containing flexible pouches, themselves containing the base tints; the cells then being mounted removably on the carousel.

According to subsidiary characteristics that are advantageous:

- the support for the collector receptacle is disposed in the central portion of the carousel;
- the support for the collector receptacle further includes weighing means;
- each deformable pouch includes a valve mounted on the pouch and projecting out from the cell through a hole in the carousel rim wall towards the collector receptacle, the metering means being means of the device that are suitable for co-operating with the valve mounted on the pouch in order to control actuation thereof; and
- the indexing means comprise means for driving the carousel in rotation and the device includes means for use during said drive to declutch the means driving the carousel in permanent rotation.

The invention also provides a method of preparing a mixture of base tints by means of a device as described above, the method comprising the following steps:

a) driving the carousel in rotation to a delivery position in which the cell containing the pouch corresponding to the selected tint is placed in register with the collector receptacle;

b) pressurizing the inside volume of the cell;

c) opening the expulsion orifice in controlled manner to expel a predetermined quantity of tint into the collector receptacle, the pressure established in step b) being maintained at least throughout the duration of step c); and d) reiterating steps a) to c) for other tints that are to be incorporated in the mixture.

Advantageously, during step c), provision is made for continuously weighing the collector receptacle simultaneously with the tint being expelled, the opening of the expulsion orifice being controlled by data derived from said weighing.

◇

There follows a description of an embodiment of the device of the invention given with reference to the accompanying drawings in which the same numerical references are used from one figure to another to designate elements that are identical or functionally similar.

Figure 2:
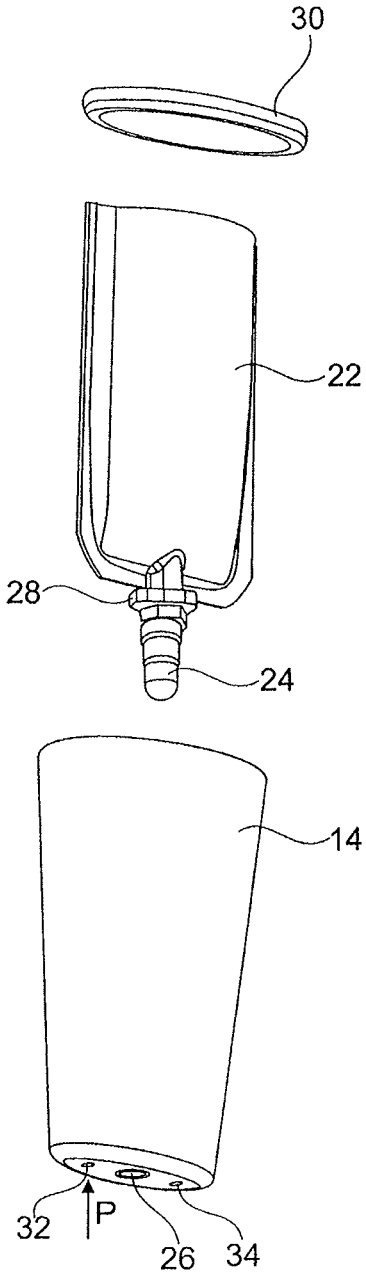
FIG. 2 is an exploded perspective view showing a receptacle for base tint, constituted by a deformable pouch associated with a cell designed to be mounted on the carousel.
Figure 3:
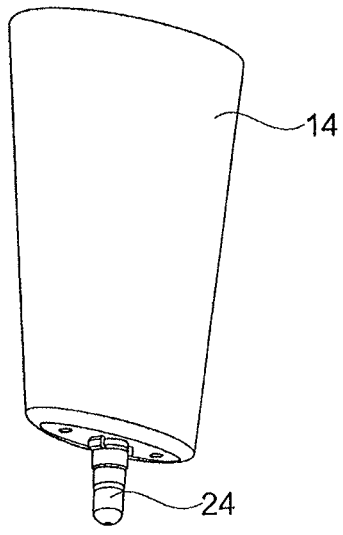

FIG. 3 corresponds to FIG. 2 after the pouch has been inserted in the cell and the cell has been closed.

◇

Figure 1:
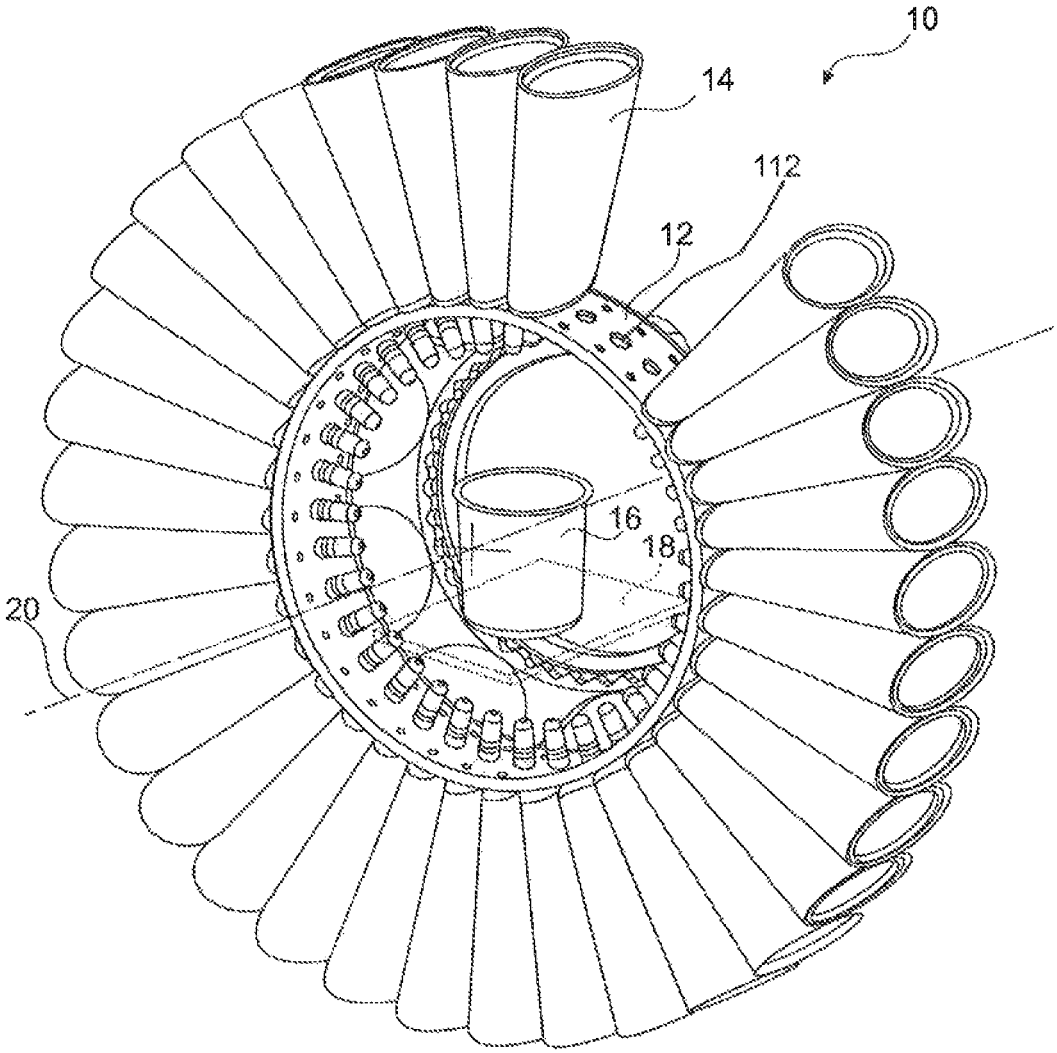
FIG. 1 is a general view of a device of the invention, including an element in the form of a rotary carousel having an axis that is horizontal.

In FIG. 1, reference 10 designates a device of the invention for storing, selecting, and measuring out base tints.

The device comprises a circular metal structure with a horizontal axis, the structure being similar to a wheel rim 12 and comprising a cylindrical wall with a plurality of through holes 112 circumferentially spaced about the rim and having a plurality of radial cells 14 mounted thereon for receiving and storing respective base tints.

The assembly forms a carousel that may be rotated by appropriate indexing means (not shown) that may be manual or automatic, enabling any one of the cells 14 to be placed facing a collector receptacle 16 designed to receive a plurality of base tints in succession in order to produce a mixture of tints for use in preparing on demand a paint having a particular shade.

The collector receptacle 16 is placed on a support 18 that includes electronic scales (not shown) serving to measure in real time the weight of base tints introduced into the collector receptacle 16.

In addition to indexing for the purpose of selecting base tints, the carousel has the function of producing a turning gravity field suitable for preventing particles present in suspension in the tints from settling. For this purpose it is associated with a motor enabling the wheel rim 12 to be caused to turn about the horizontal axis 20 with permanent rotary motion that is slow (e.g. one revolution per hour). The permanent rotation is not necessarily continuous, it may be performed intermittently, providing it serves to conserve the homogeneity of the base tints when the device is not specifically in use (for taking tints), such that the device can be ready, immediately and at any instant, for use in preparing a mixture.

Insofar as the permanent rotation is slow, a low-power (about 1 watt) micromotor with suitable gearing is sufficient in spite of the relatively heavy weight of the carousel loaded with all of the base tints. In addition to its low energy consumption, the use of such a micromotor provides a high degree of safety: a hand caught in the carousel will do no more than block the micromotor, and there is no risk of injuring the person.

During periods of use, in order to index the wheel rim to the position for taking tint from the selected receptacle, the wheel rim may be turned either automatically under motor drive, or by hand by the operator. For turning by hand, means are provided to declutch the micromotor that provides permanent rotary drive, so as to enable the operator to turn the wheel rim freely to the selected position.

Various other configurations may be envisaged for the general structure of the carousel.

Thus, in FIG. 1, the wheel rim 12 comprising a cylindrical wall with a plurality of through holes 112 circumferentially spaced about the rim is shown as being in an inside position of the carousel (with the cells mounted to and radiating outwards from the rim), however, in a variant or in addition, the rim could equally well be provided outside a ring of cells. Similarly, the collector receptacle 16 situated in the center of the carousel in FIG. 1, could be located beneath the carousel. The measured quantity of base tint is then delivered in a radially outward direction, so the orientation of the cells is inverted compared with that shown in FIG. 1.

In yet another embodiment, the collector receptacle may be located on one side, with the system for expelling tint including an angled member for directing the expelled tint in the appropriate direction.

Finally, it should be observed that the radiating configuration of the described element in which the cells extend radially relative to the axis of rotation of the carousel is not limiting, and the cells may extend in any other direction, providing the carousel rotates about an axis of rotation that is horizontal.

FIGS. 2 and 3 show how base tints are stored in the device.

Each tint is stored in a flexible deformable pouch 22 for single use.

The pouch has a valve 24 mounted thereon. By way of example, the valve may be of the type described in European patent application EP 07/290369.3 filed on Mar. 28, 2007 and entitled "Dispensing valve" in the name of Fillon Technologies. That valve may be mounted on the flexible pouch 22 by means of a quick coupling of the kind described in European patent application EP 08/290235.4 filed on Mar. 12, 2008 and entitled "Quick coupling type assembly for liquids, in particular for a flexible-pouch receptacle" in the name of Fillon Technologies.

The pouch 22 fitted with its valve 24 is inserted in a respective cell 14. At one of its ends, each cell has an orifice 26 enabling the valve 24 to pass through the bottom wall of the cell so that the valve projects from the cell 14 and is accessible from the outside, as shown in FIG. 3. The closed volume defined by the cell is sealed by a gasket 28 around the orifice 26 and by a closure cover 30 at the opposite end. Once the flexible pouch has been inserted in the cell, the assembly comprising the pouch 22 and the cell 14 forms an individual receptacle storing a given base tint.

Each cell 14 also includes a passage 32 for putting the closed inside volume of the cell into communication with a pressure source P (not shown), e.g. a source of compressed air forming part of the device 10. The cell also has means 34 enabling it to be radially mounted on the cylindrical wall of wheel rim 12.

Once the assembly comprising the pouch 22 and the cell 14 has been assembled (as shown in FIG. 3), the volume inside the cell may be put under pressure by applying the pressure P. This has the effect of compressing the deformable flexible pouch 22 housed inside the cell, such that the content of the pouch, i.e. the base tint, is at a pressure greater than atmospheric pressure.

This pressurization may be permanent. It is also possible, and preferable, for pressurization to be applied solely at the time of use, after the base tint has been selected. Under such circumstances, the pressure P is applied only when the corresponding cell has been put into the delivery position, in register with the collector receptacle 16.

The device is then ready to expel the base tint into the collector receptacle.

This expulsion is performed by controlling the valve 24, with the valve being opened for a duration that is controlled—automatically or manually—on the basis of data derived from the weighing performed continuously by the scales associated with the support tray 18 receiving the collector receptacle 16, until the exact required weight has been obtained.

Since the pressure is maintained in the cell at least throughout this delivery stage, the base tint may be delivered under conditions that are completely reproducible, and without any risk of air penetrating into the pouch at the moment the valve is closed (since the content of the pouch is then still at a pressure that is greater than or equal to atmospheric pressure).

The above-described device also serves, outside delivery periods, to preserve the homogeneity of the base tints by continuous rotation of the carousel, and during delivery it ensures measurement that is particularly accurate and reproducible by the controlled pressurization of the cell containing the pouch storing the selected base tint.

Furthermore, with such a device, risks of soiling are practically non-existent.

With the above-described pouch 22 and cell 14 configuration, the valve 24, which is the only element that might be subjected to primary soiling, is connected to the single use pouch 22 and thus to the portion that is consumable. In contrast, the cell 14 that remains permanently mounted on the cylindrical wall of wheel rim 12 forms an element that can be separated from the assembly comprising the pouch 22 and the valve 24.

The pressure source (a source of compressed air), and the means for pressurizing the pouch (the cell forming a closed volume) thus form integral portions of the device proper (ignoring consumables) and they are normally never in contact with the base tint (confined within the pouch 22 and the valve 24)—unlike devices in which paint is stored in a receptacle having a piston type moving bottom or, even worse, devices based on rigid tins having a metering lid with a stirring helix.

The risks of soiling and corrosion as a result of splashes of base tint are thus avoided, such that the device may be installed permanently and used without taking special precautions in an environment that is clean, which constitutes a major additional advantage for professionals;

Finally, it should be observed that the consumable portion, i.e. the portion that is changed, may take various forms:

- a removable flexible pouch 22: the cells 14 are permanently mounted on the carousel, and the flexible pouches are inserted in respective cells of the device (as shown in FIG. 2, for example);

a rigid or semi-rigid cartridge (not shown) constituting packaging containing a flexible pouch 22 that forms an integral portion of the removable cartridge: the cells are permanently mounted on the carousel and the cartridges are inserted in respective cells of the device (where the term "semi-rigid" is used to mean a cartridge of the type that can be deformed, but that subsequently returns to its initial shape); and a cell 14 containing a flexible pouch 22, together corresponding to the container shown in FIG. 3, for example: the cells are then mounted in removable manner on the carousel.

The invention claimed is:

1. A method of preparing a mixture of base tints by means of a device, the device comprising a plurality of containers storing different respective tints, each container having a tint expulsion orifice, a horizontal-axis carousel having a circumferential rim (12) comprising a cylindrical wall with a plurality of through holes and carrying the containers disposed in a circumferential configuration with at least the expulsion orifice of each container projecting through one of the holes in the rim wall, the carousel having a plurality of cells (14) removably mounted to, and projecting in a radial direction from the rim wall, each cell defining a closed inside volume suitable for housing in airtight manner a flexible deformable pouch (22) containing a base tint, the cell and the associated pouch forming the container, a support (18) for a collector receptacle (16), indexing means for causing the carousel to turn to a delivery position in which the expulsion orifice of a selected container is placed in register with the collector receptacle, metering means suitable for acting in the delivery position to control opening of the expulsion orifice to expel a predetermined quantity of tint into the collector receptacle, and drive means for driving the carousel in permanent rotation, continuously or at intervals, to produce a gravity field that turns relative to the contents of the containers so as to avoid particles present in suspension in the tints from settling, pressure source (P), and means (32) for establishing communication, at least for the selected container in the delivery position, between the pressure source and the closed inside volume of the cell prior to expelling the predetermined quantity of tint, wherein the method comprises the steps of a) driving the carousel in rotation to a delivery position in which the cell containing the pouch corresponding to the selected tint is placed in register with the collector receptacle, b ) pressurizing the inside volume of the cell after the cell containing the pouch corresponding to the selected tint is in the delivery position, placed in register with the collector receptacle (16), c) opening the expulsion orifice in controlled manner to expel a predetermined quantity of tint into the collector receptacle, the pressure established in step b) being maintained until closing the expulsion orifice, wherein provision is made for continuously weighing the collector receptacle simultaneously with the tint being expelled, the opening of the expulsion orifice being controlled by data derived from the weighing, and d) reiterating steps a) to c) for other tints that are to be incorporated in the mixture.

2. The method of claim 1, wherein the cells (14) are radial cells with the expulsion orifice of each container directed radially relative to the axis of the carousel.

3. The method of claim 1, wherein the cells are mounted permanently on the carousel, the device being suitable for being filled with the removable flexible pouches containing the base tints, the flexible pouches being inserted for this purpose into respective cells of the device.

4. The method of claim 1, wherein the cells are mounted permanently on the carousel, the device being suitable for being filled with rigid or semi-rigid cartridges containing the flexible pouches containing the base tints, the cartridges being inserted for this purpose into respective cells of the device.

5. The method of claim 1, wherein the cells are removably mounted on the carousel, the device being suitable for being loaded with removable cells containing the flexible pouches themselves containing the base tints.

6. The method of claim 1, wherein the support (18) for the collector receptacle (16) is disposed in the central portion of the carousel.

7. The method of claim 1, wherein the support (18) for the collector receptacle further includes weighing means.

8. The method of claim 1, wherein:

each deformable pouch (22) includes a valve (24) mounted on the pouch, the valve projecting from the cell towards the collector receptacle; and the metering means are means of the device suitable for co-operating with the valve mounted on the pouch in order to control the actuation thereof.

9. The method of claim 1, wherein:

the indexing means comprise means for driving the carousel in rotation; and the device includes declutching means operable while the carousel is being driven to declutch the means for driving the carousel in permanent rotation.

* * * * *